United States Patent [19]

Mapes

[11] 4,150,780

[45] Apr. 24, 1979

[54] AUTOMATIC MAILBOX SIGNAL

[76] Inventor: Leland O. Mapes, Box 63, Unionville Center, Ohio 43077

[21] Appl. No.: 893,987

[22] Filed: Apr. 6, 1978

[51] Int. Cl.[2] ..... B65D 91/00

[52] U.S. Cl. ..... 232/35

[58] Field of Search ..... 232/34, 35

[56] References Cited

U.S. PATENT DOCUMENTS

| | | | |
|---|---|---|---|
| 1,060,659 | 5/1913 | Ammann | 232/35 |
| 1,929,965 | 10/1933 | Black et al. | 232/35 |
| 1,973,020 | 9/1934 | Smith | 232/35 |
| 3,143,287 | 8/1964 | Holt | 232/35 |
| 3,318,516 | 5/1967 | Scheerer | 232/35 |
| 3,648,924 | 3/1972 | Burns | 232/35 |

*Primary Examiner*—Roy D. Frazier
*Assistant Examiner*—Peter A. Aschenbrenner
*Attorney, Agent, or Firm*—Frank H. Foster

[57] ABSTRACT

An automatic, signalling flag device for rural-type mailboxes. A large metal or plastic signal flag is hinged to the side of the mailbox and is aligned and mounted for pivotal movement in a plane which is laterally transverse of the mailbox. The flag has a raised position, a lowered position to which it can fall by gravity and has a hole through it. A rod is mounted to the exterior of the mailbox for retaining the flag in the raised position and releasing it upon opening of the mailbox door, permitting the flag to fall to its lowered position. The rod is slideably mounted to a fastener which is pivotally mounted to the mailbox rearwardly of the signal flag, extends forwardly to a position where it is bent into a bayonet which is extendable into the hole in the flag, then extends forwardly to an L-shaped bend at the mailbox door and extends across the front, exterior face of the door into pivotable connection with a front fastener means mounted in the door. The rod is pulled forwardly by opening of the door to withdraw the bayonet and release the signal flag, allowing it to fall signalling that the door has been opened for the deposit of mail.

2 Claims, 2 Drawing Figures

AUTOMATIC MAILBOX SIGNAL

BACKGROUND OF THE INVENTION

This invention relates generally to signalling devices and more particularly relates to a device for automatically signalling the fact that a mailbox has been opened.

In rural areas as well as some suburban areas, mail is delivered directly from a vehicle rather than by a mail carrier on foot. This necessitates the use of the conventional, rural-type of mailbox which is mounted on a post or other means next to the road. The mailbox is often located a significant distance from the house for which the mail is intended and in rural areas the distance may be very substantial.

It would therefore be a significant convenience to have a signalling device to permit an inhabitant of the house to discern from the house whether or not mail has been delivered. Without such a device, the inhabitant must walk or bicycle to the mailbox and open it to determine this fact. Such a signalling device would prevent unnecessary trips to the mailbox especially on those days when the mail carrier is late or no mail was contained in that day's delivery for the particular house.

Such a signal is also a convenience to the home owner who may be arriving home in his automobile and wishes to know whether mail has been delivered without the necessity of pulling the car over to the mailbox or getting out of the car. In both of the above examples, the occurrence of inclement weather makes such a signalling device even more of a convenience.

There is, therefore, a need for a signalling device which will activate the signal automatically as a result of the opening of the door by the mail carrier who can not be expected to separately activate a signal in addition to delivering the mail. Additionally there is a need for such a signalling device in which the status of the signal is plainly visible from a substantial distance away at the house. With such a device, a person located at a remote point can easily see whether the mailbox has been opened for the deposit of the mail.

In addition to being plainly visible from a substantial remote distance it is desirable that the signalling means at no time obscure the name or number which may be painted on the side of the mailbox from persons travelling along the road who may need to read the name on the mailbox to find the residence of a particular person.

Many others have suggested a substantial variety of devices for signalling the opening of the mailbox. However, such devices are usually characterized by a relatively complicated mechanical apparatus which makes the device expensive, unsightly and difficult to install.

OBJECTS AND SUMMARY OF THE INVENTION

It is therefore an object of the present invention to provide an automatic mail delivery signalling device of such simplicity and economy that it may be quickly and inexpensively attached to a mailbox with a minimal amount of modification of the mailbox.

It is another object of the present invention to provide such a signalling device which is highly visible from a person's house at substantial remote distances from the mailbox and yet does not obscure from a passerby a name or number printed on the mailbox.

A still further object of the present invention is to provide a reliable and durable automatic signalling device which does not have the appearance of a complicated and unsightly contraption attached to a person's mailbox.

Yet another object of the present invention is to provide a mailbox signalling means which can be packaged and sold as a small kit of few parts and which can be quickly installed on a mailbox of any size.

In summary, the signalling device of the present invention has a signal flag which is pivotally mounted to the exterior of the mailbox and which has a first catch means. The signal flag has a raised, latched position and a lowered, activated position to which it will fall by gravity. An elongated activating member is slideably mounted to the exterior of the mailbox and is also pivotally attached to the mailbox door. The activating member has a second catch means mating with the first catch means of the signal flag for retaining the signal flag in the raised position when the door is closed and for being slid towards the door and releasing the catch means upon opening of the mailbox door.

Further objects and features of the present invention will be apparent from the following specification and claims when considered in connection with the accompanying drawings illustrating the preferred embodiment of the invention.

Figure 1:
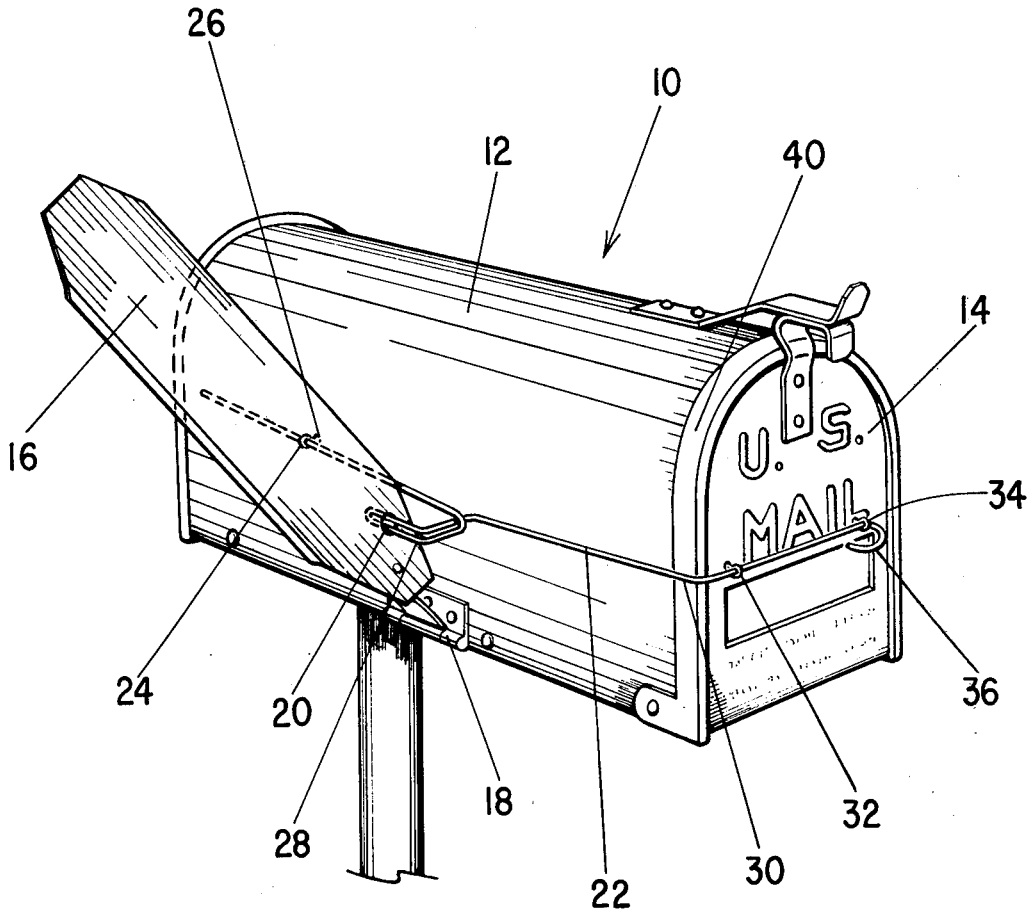
FIG. 1 is a view in perspective of a mailbox and signalling means embodying the present invention with the signalling flag shown in its raised, latched and unactivated state.

In describing the preferred embodiment of the invention illustrated in the drawings, specific terminology will be resorted to for the sake of clarity, however, it is not intended to be limited to the specific terms so selected and is to be understood that each specific term includes all technical equivalents which operate in a similar manner to accomplish a similar purpose.

DETAILED DESCRIPTION

FIG. 1 illustrates a mailbox 10 of the rural-type which has an enclosed receptacle 12 with a hinged front door 14 for access to its interior. The embodiment of FIG. 1 has a signal which is a signal flag 16.

The signal flag 16 is preferably a large sheet of relatively rigid material such as plastic or metal which is cut to a relatively large size and may be painted or otherwise colored in a bright color of clear visibility. The signal flag 16 is pivotally mounted to the exterior of a mailbox by means of a hinge 18. It is aligned in a plane which is laterally transverse to the mailbox and parallel to the door 14 when the door is closed. The flag 16 and hinge 18 are aligned so that the signal flag 16 will pivot in the same plane. This orientation and pivotal movement permits the flag to clearly be seen from a home which is set back a significant distance from the road, usually somewhere near a line which is substantially perpendicular to the road. Yet the same alignment provides for nearly no obscuring of any writing painted on the side of the mailbox to a person viewing the mailbox from the road or while travelling along the road.

Figure 2:
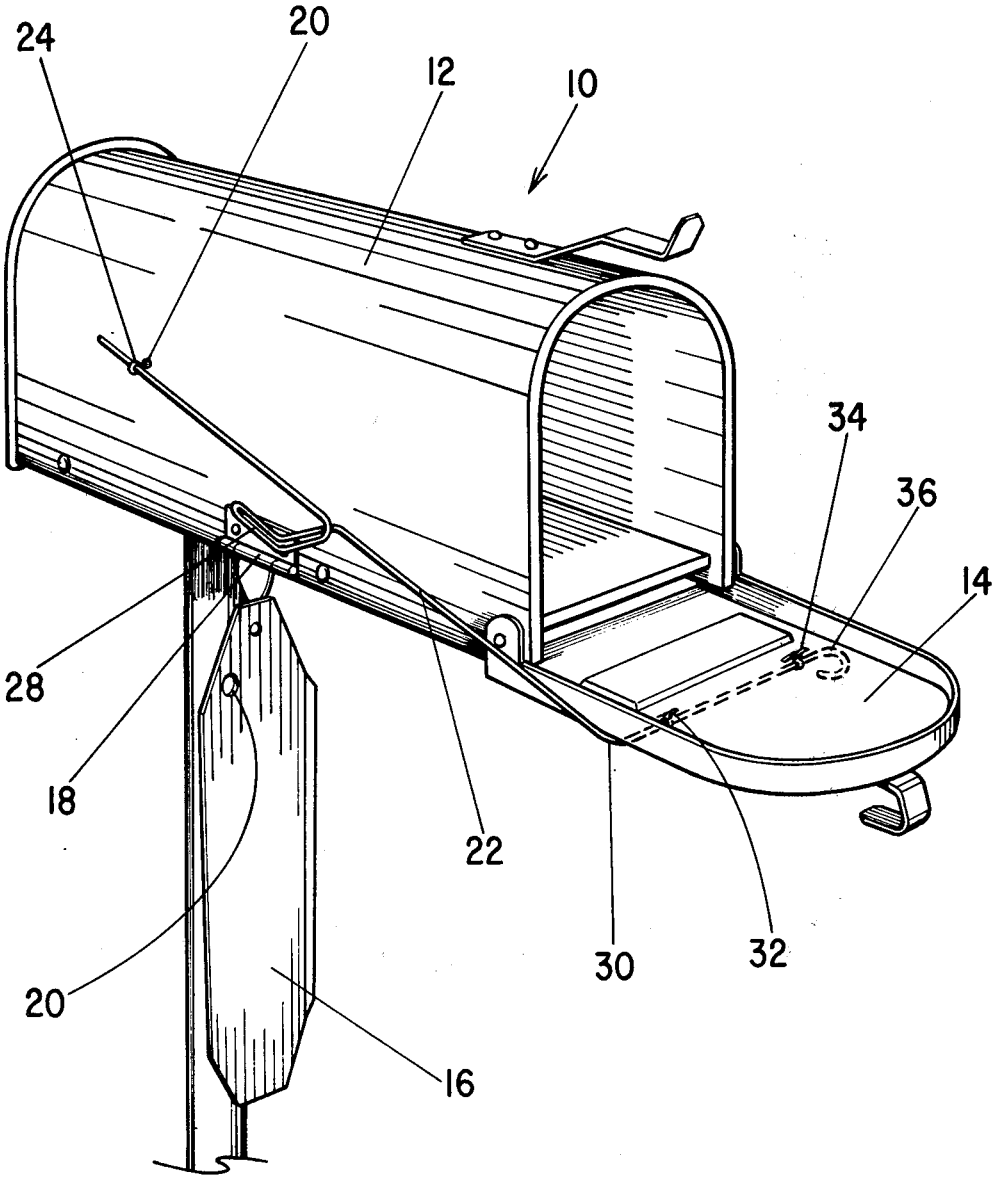
FIG. 2 is a view in perspective of the embodiment of FIG. 1, but showing the mailbox with its door open and the signal flag in its lowered, activated state.

The signal flag 16 is also provided with a first catch means which, in the preferred embodiment, is a hole 20 through the signal flag. The signal flag therefore has a raised, latched position illustrated in FIG. 1 as well as a lowered, activated position illustrated in FIG. 2 to which it will fall by gravity upon its release.

The signal flag and its hinge may be attached to either side of the mailbox. Therefore, they can be attached so that they do not interfere with the conventional signal flag which for outgoing mail is ordinarily provided on mailboxes which are approved by the postal authorities. Also, where two mailboxes may be mounted side by side, the signal flag may be mounted opposite the interfacing sides of the mailboxes so that it will not strike the adjacent mailbox.

An elongated activating member is slideably mounted to the exterior of the mailbox and is pivotally attached to the door 14. The preferred activating member illustrated in the figures is a rod member 22 which is slideably mounted to a first fastener means 24. The first fastener means 24 is pivotally mounted to the mailbox rearwardly of the signal flag 16. The preferred fastener means is a cotter pin with the rod 22 extending through its head. The cotter pin extends through a hole 26 in the mailbox and has its legs bent apart inside the mailbox to prevent it from slipping out of the hole 26.

From the fastener means 24, the rod 22 extends forwardly to a position laterally adjacent the signal flag 16. There it is bent into a bayonet 28 which extends rearwardly through the hole 20 in the signal flag 16 when the mailbox door 14 is closed. The rod 20 is, however, constructed so that upon forward movement of the rod 22 as described above, the bayonet 28 will be withdrawn from the hole 20 permitting the signal flag 16 to fall to its activated position illustrated in FIG. 2. This bayonet therefore forms a second catch means which mates with the hole 20. As shown in FIG. 1 the bayonet catch means 28 retains the signal flag in its raised position when the door 14 is closed.

From the bayonet 28, the rod 22 extends further forwardly to an L-shaped bend 30 laterally of the door 14 and then extends across the front exterior face of the door 14.

This front portion of the rod 22 is pivotally connected to the door 14 by means of fasteners 32 and 34 so that the fasteners can pivot about this portion of the rod when the door is opened. The end of the rod is then formed into a bend 36 so that the force exerted by the raised signal flag 16 can not pull the rod from the fasteners 32 and 34. Preferably the front fastener means 32 and 34 are also cotter pins attached in the same manner as the fastener 24.

In operation the signal flag 16 initially may be lifted and set to the state illustrated in FIG. 1. When the mail carrier arrives and opens the door 14, the opening motion of the door 14 will pull the rod 22 forwardly and downwardly at its front end. The rod will slide forwardly in its pivot fastener 24 to permit the bayonet 28 to be withdrawn from the hole 20. This will release the catch means and permit the flag 16 to fall by gravity to the position illustrated in FIG. 2. After the mail is delivered the mail carrier merely closes the door, thus operating the door during the mail delivery in an entirely conventional manner. The signal flag, however, will remain in the lower position where a person can plainly see from a great distance that it has been released. This will indicate that mail has been delivered.

When the homeowner opens the mailbox door 14 to retrieve the delivered mail he or she will, prior to closing the door, grasp the flag 16 and rotate it upwardly so that upon closing the door the bayonet 28 will be reinserted into the hole 20.

As alternatives, other fastener means, such as screw eyes, may be utilized. Furthermore, the fastener means on the door can alternatively be connected to the side flange 40 of the door 14 by means of a single fastener through the side flange. For example, the single fastener might be a bolt around which the rod is bent to form an eye.

Furthermore, by bending the rod 22 into other shapes or by using an elongated activating member of a somewhat different construction, the signal flag can be pivotally connected at other positions on the mailbox. Furthermore, it should be readily apparent to those skilled in the art that other types of catch means could be utilized. For example, a bayonet could be formed upon the signal flag 16 in place of the hole and a loop could be formed in place of the bayonet 28 to provide equivalent catch means and equivalent operation.

It is to be understood that while the detailed drawings and specific examples given describe preferred embodiments of the invention, they are for the purpose of illustration, that the apparatus of the invention is not limited to the precise details and conditions disclosed and that various changes may be made therein without departing from the spirit of the invention which is defined by the following claims.

I claim:

1. An automatic signalling device for a mailbox of the type having an enclosed receptacle with a hinged door for access to its interior, the signalling device comprising:

(a) a signal flag pivotally mounted to the exterior and side of said mailbox and having a first catch means comprising a hole through said signal flag, said signal flag having a raised, latched position and a lower activated position to which it will fall by gravity, said flag being aligned and pivotally mounted for pivotal movement in a plane which is laterally transverse to said receptacle and parallel to said door when in the closed position;

(b) an elongated activating member slideably mounted to the exterior of said receptacle and pivotally attached to said door, said activating member having a second catch means mating with said first catch means of said flag for retaining said signal flag in said raised position when said door is closed and for being slid toward said door and releasing said latching means upon opening of said door, said second catch means comprising a bayonet extending rearwardly through said hole when said door is closed and withdrawable from said hole upon opening of said door, said activating member more particularly comprising a rod member slideably mounted to said receptacle rearwardly of said signal flag, said rod extending forwardly and having an L-shaped bend laterally of the door for extending across the front, exterior face of said door, said rod being pivotally connected to front fastener means mounted to the face of said door and bent to prevent lateral withdrawal from said front fastener means, said rod member having said bayonet formed thereon.

2. A signalling device according to claim 1 wherein said first fastener means comprises a cotter pin having its legs extending through a hole in said receptacle and bent apart and wherein said front fastener means comprises a spaced pair of cotter pins each having its legs extending through a different hole through said door and bent apart.

* * * * *